United States Patent [19]

Dueweke et al.

[11] 4,274,458

[45] Jun. 23, 1981

[54] LOG SPLITTERS

[76] Inventors: Gilbert R. Dueweke, 17435 Stephens Dr.; John J. Krobock, 17425 Stephens Dr., both of East Detroit, Mich. 48021

[21] Appl. No.: 95,255

[22] Filed: Nov. 19, 1979

[51] Int. Cl.[3] ..... B27L 7/00

[52] U.S. Cl. ..... 144/193 D; 144/193 R

[58] Field of Search ..... 173/128, 129, 130, 131, 173/132, 133; 125/23 R; 144/193 R, 193 B, 193 C, 193 D, 193 F

[56] References Cited

U.S. PATENT DOCUMENTS 4,211,264 7/1980 Cross ..... 144/193 D

*Primary Examiner*—W. Donald Bray

*Attorney, Agent, or Firm*—Barnes, Kisselle, Raisch & Choate

[57] ABSTRACT

A log splitter comprising a wedge supported on an upright in overlying position with respect to a log to be split and guided on the upright toward the log when the wedge is struck by a hammer. An auxiliary driver is supported on the upright for movement into and out of alignment with the wedge and for movement with the wedge such that when a log is initially split by the wedge and becomes jammed in the log or is driven into the log so that the hammer cannot reach it, the auxiliary driver may be brought into alignment with the wedge and the hammer will then strike the auxiliary driver and drive the wedge through the log.

3 Claims, 5 Drawing Figures

LOG SPLITTERS

BACKGROUND AND SUMMARY OF THE INVENTION

In the manual splitting of logs, it is common to utilize a wedge which is driven by a sledge hammer into the log. In order to guide the wedge, it has been heretofore proposed to mount the wedge on an upright for movement toward and away from the log as, for example, in U.S. Pat. Nos. 3,865,163, 3,982,572 and 4,033,390. One of the problems with respect to the use of a wedge, whether a free wedge or a guided wedge, is that the wedge may become jammed in the log or may be driven into the log so far that it cannot be reached by the sledge hammer.

Accordingly, among the objectives of the present invention is to provide a simple, effective, low cost log splitter which includes means for effectively driving the wedge through the log in the event that it becomes jammed or driven into the log such that it cannot be readily struck by the hammer.

Basically, the invention includes a guided wedge and an auxiliary driver which is mounted for movement into and out of alignment with the wedge and which is guided with the wedge so that when the auxiliary driver is struck, the wedge is driven further into the log to split the log.

DESCRIPTION

Figure 2:
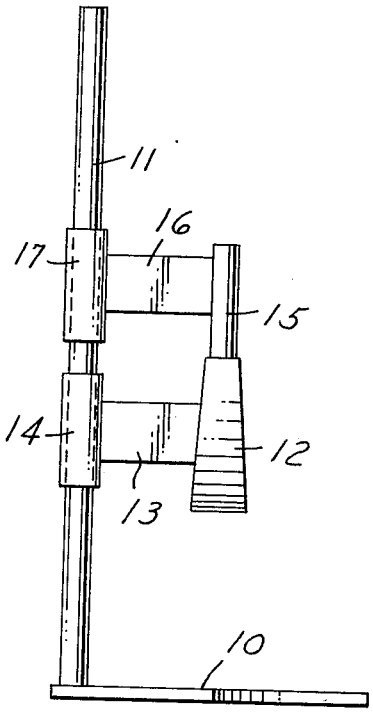
FIG. 2 is a side elevational view of the same.
Figure 3:
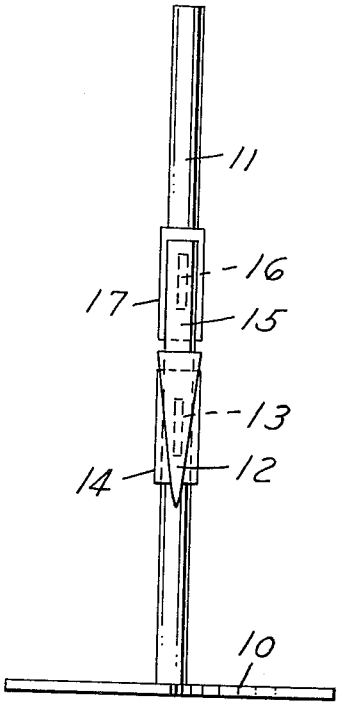
FIG. 3 is a front elevational view of the same.
Figure 4:
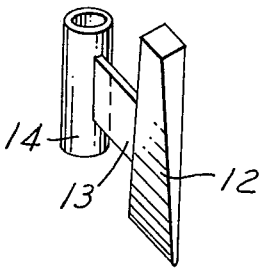
FIG. 4 is a perspective view of the wedge.
Figure 5:
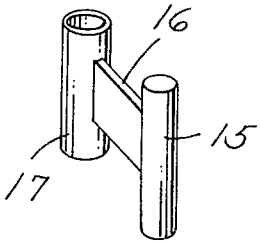
FIG. 5 is a perspective view of the auxiliary driver.
Figure 1:
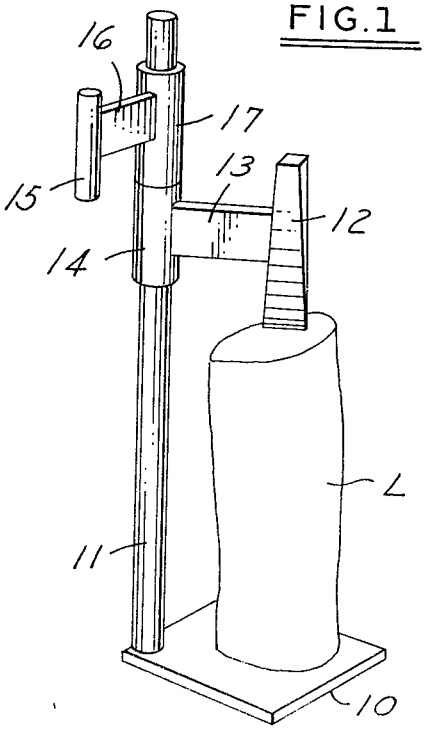
FIG. 1 is a perspective view of a log splitter embodying the invention.

Referring to the drawings, the log splitter embodying the invention comprises a base 10 preferably in the form of a square plate having an upright 11 in the form of a cylindrical post mounted at one corner of the base. A wedge 12 is supported by a bracket 13 that includes a cylindrical portion 14 telescoped over and slidable on the post 11 such that the wedge is guided vertically in a direction parallel to the axis of the post. An auxiliary driver 15 in the form of a solid cylindrical part is slidably and rotatably mounted on the post 11 by a bracket 16. The bracket 16 includes a cylindrical portion 17 telescoped over the post so that the auxiliary driver is guided for rotating movement about the axis of the post toward and away from alignment with the wedge 12 and for vertical sliding movement along the post.

In use, a log L is placed on the base 10 and the wedge 12 is swung into desired position over the upper end of the log. Initially, the auxiliary driver 15 is swung away from the wedge. The sledge hammer is then brought into engagement with the upper end of the wedge 12 driving the wedge into the log. In the event that the wedge 12 becomes jammed or is driven into the log such that it cannot be struck by the sledge hammer, the auxiliary driver 15 is swung into alignment with the wedge 12 and then the sledge hammer is caused to strike the wedge driving the wedge downwardly moving it out of any jammed position and finally splitting the log.

Satisfactory results have been achieved with parts having the following dimensions:

base—12″×12″×½″
upright—36″×1.89″ O.D. or 1½″ black pipe
wedge—8″ long-1¾″ square top
auxiliary driver—6″×1½″ O.D.
cylindrical portions 14, 17—6″×2.37″ O.D. or 2″ black pipe It can thus be seen that there has been provided a log splitter which is simple, effective, low in cost, and effectively prevents permanent jamming of the wedge and facilitates splitting the log when the wedge becomes driven into the log so that is cannot be struck by the sledge hammer.

What is claimed is:

1. A log splitter comprising
a wedge,
means for supporting said wedge in overlying position with respect to a log to be split and for guiding said wedge toward said log when the wedge is struck by a hammer,
an auxiliary driver,
means for supporting said driver for movement into and out of alignment with said wedge and for movement with said wedge such that when a log is initially split by the wedge and becomes jammed in the log or is driven into the log so that the hammer cannot reach it, the auxiliary driver may be brought into alignment with the wedge and the hammer will then strike the auxiliary driver and drive the wedge through the log.

2. The log splitter set forth in claim 1 wherein said means for supporting and guiding said wedge and said means for supporting and guiding said auxiliary driver comprise
a base,
an upright,
and means for slidably mounting said wedge for movement of the parallel to the axis of said upright,
and means for supporting said auxiliary driver on said upright for swinging movement about the axis of said upright and for movement parallel to the axis of said upright.

3. The log splitter set forth in claim 2 wherein said upright comprises
a post having a circular exterior surface,
said means for supporting said wedge comprises a bracket having a cylindrical opening therethrough telescoped over said post,
said means for mounting said auxiliary driver comprises a bracket having a cylindrical opening therein telescoped over said post.

* * * * *